United States Patent [19]

Arntzen et al.

[11] Patent Number: 4,650,518

[45] Date of Patent: Mar. 17, 1987

[54] CONTAINER FOR THE FINAL STORAGE OF RADIOACTIVE WASTES

[75] Inventors: Paul Arntzen, Alzenau; Hans Pirk; Horst Vietzke, both of Maintal; Hans Wingender, Mömbris, all of Fed. Rep. of Germany

[73] Assignee: Nukem GmbH, Hanau, Fed. Rep. of Germany

[21] Appl. No.: 681,579

[22] Filed: Dec. 14, 1984

[30] Foreign Application Priority Data

Dec. 22, 1983 [DE] Fed. Rep. of Germany ..... 3346355

[51] Int. Cl.[4] ..... C22C 43/00

[52] U.S. Cl. ..... 420/3; 250/506.1; 250/515.1; 252/633

[58] Field of Search ..... 75/122.7; 252/633; 250/506.1, 515.1

[56] References Cited

U.S. PATENT DOCUMENTS

| | | | |
|---|---|---|---|
| 2,756,489 | 7/1956 | Morris | 75/122.7 |
| 2,789,072 | 4/1957 | White, Jr. | 75/122.7 |
| 3,072,475 | 1/1963 | Baker et al. | 75/122.7 |
| 3,089,768 | 5/1963 | Kittel | 75/122.7 |
| 3,266,890 | 8/1966 | Greenspan et al. | 75/122.7 |
| 3,545,966 | 2/1968 | Colombie et al. | 75/122.7 |

FOREIGN PATENT DOCUMENTS

| | | | |
|---|---|---|---|
| 657285 | 6/1965 | Belgium | 75/122.7 |
| 816603 | 7/1954 | United Kingdom | 75/122.7 |
| 983803 | 2/1965 | United Kingdom | 75/122.7 |
| 984489 | 2/1965 | United Kingdom | 75/122.7 |
| 984846 | 3/1965 | United Kingdom | 75/122.7 |
| 984847 | 3/1965 | United Kingdom | 75/122.7 |

*Primary Examiner*—Stephen J. Lechert, Jr.
*Assistant Examiner*—Anne Brookes
*Attorney, Agent, or Firm*—Cushman, Darby & Cushman

[57] ABSTRACT

There is proposed for the final storage of radioactive wastes a container made of an uranium alloy which compared to known containers made of uranium is less susceptible to corrosion and does not show any anisotropic thermal expansion at high temperatures. For this purpose, there is alloyed with uranium, which is preferably depleted, 5 to 15 wt. % molybdenum, 2 to 15 wt. % copper, 1 to 5 wt. % zirconium, 0.5 to 5 wt. % chromium, 0.5 to 2 wt. % nickel, 0.5 to 1.5 wt. % niobium, and 0 to 5 wt. % iron with the proviso that the total content of the alloying metals is 10 to 16% and the total of chromium, nickel, and niobium is at least 1.5%.

12 Claims, 1 Drawing Figure

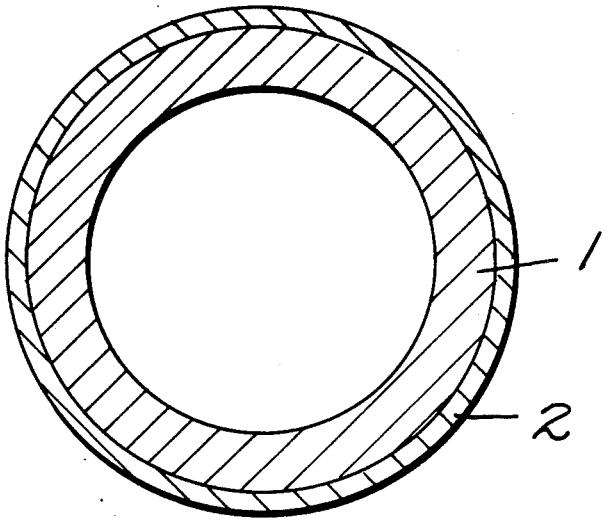
1
2

CONTAINER FOR THE FINAL STORAGE OF RADIOACTIVE WASTES

BACKGROUND OF THE INVENTION

The invention is directed to a container for the final storage of radioactive waste using uranium as the material protecting against rays within the container walls.

Containers are known for radioactive materials which contain uranium as a radiation protective material between an inner and outer jacket of the container body, in the shielding cover and on the bottom of the container, see for example German OS No. 2304665. The uranium cast body used for this in the form of depleted material must always be encapsulated in another work material since they are not resistant to oxidation and corrosion.

In addition, because uranium has anisotropic properties and, therefore, is expanded differently in the three dimensions by heating in contrast to the customary encapsulating materials such as, e.g., steel, breaks can occur in filling the container with strongly heat emitting radioactive materials or in the prescribed fire test (30 minutes at 800° C.) which damage the container.

Therefore, it was the problem of the present invention to provide a container for the final storage of radioactive waste with uranium as radiation protecting material inside the container walls in which breaks at high temperatures are ruled out and which is less susceptible to corrosion.

SUMMARY OF THE INVENTION

This problem was solved according to the invention by employing uranium alloys containing 5 to 15 wt.% molybdenum, 2 to 15 wt.% copper, 1 to 5 wt.% zirconium, 0.5 to 5 wt.% chromium, 0.5 to 2 wt.% nickel, 0.5 to 1.5 wt.% niobium, and 0 to 5 wt.% iron, balance uranium, with the proviso that the total content of the alloying metals is 10 to 16% and the total of chromium, nickel, and niobium is at least 1.5% as the radiation protecting material.

In contrast to pure uranium metal and known uranium alloys, these alloys have a substantially higher resistance to corrosion, so that they can be used directly as container and radiation protecting material in which case the only additional need is 1 to 2 mm thin sheets to retain the alpha and beta rays eminating from the nucleus and thick walled capsulations or steel jackets are no longer necessary. Furthermore, these alloys exhibit practically no anisotropy in regard to different thermal expansion.

Unless otherwise indicated, all parts and percentages are by weight.

The composition can consist essentially of or consist of the stated materials.

BRIEF DESCRIPTION OF THE DRAWINGS

The single FIGURE of the drawings schematically shows a cross section through a container.

DETAILED DESCRIPTION

The following alloys have proven especially advantageous:

(a) 89% uranium, 8% molybdenum, 1% zirconium, 1% chromium, and 1% nickel.

(b) 88.5% uranium, 5% molybdenum, 5% zirconium, 1.5% niobium.

(c) 88.5% uranium, 4% copper, 5% zirconium, 1% chromium, 1.5% niobium.

(d) 85% uranium, 5% copper, 4% zirconium, 5% chromium, 1% nickel.

These alloys are resistant to radiation and display only about a 10% lower radiation shielding effect than pure uranium. No problems are presented in production of the alloys by melting nor does the casting of the corresponding molded article. Depending on the requirements as to corrosion resistance corresponding to the different geological formation of the final storage, the additions of the alloying metal can be varied within the required regions.

The use of uranium alloys as radiation protective materials and container material has the further advantage that depleted uranium which accumulates in large amounts by the enrichment of uranium 235 and likewise must be treated as radioactive waste is simultaneously final storaged without the need for a specific container for this purpose. This is likewise true for repeatedly worked uranium from the reprocessing of spent fuel elements which because of the enrichment of the nonfissionable uranium 236 no longer can be used for the production of fuel elements.

The alloying of copper and zirconium to uranium serves above all to improve the corrosion properties. The zirconium content should not be higher than 5% since otherwise the melting point of the alloy is reduced too greatly. The alloying in of iron is likewise possible, in which case also no more than 5% must be added since the melting point otherwise falls below 900° C.

Molybdenum and zirconium, in cooperation with chromium, nickel and/or niobium, eliminate the anisotropy of the uranium.

The container of the invention normally consists of a cast body made of uranium alloy which is surrounded by an about 2 mm thick sheet metal (e.g., steel) jacket which shields off the alpha and beta rays, which originate from the uranium or its decomposition products. In addition, there can be used an additional outer jacket whose work material is resistant to corrosion influences, such as, e.g., salt liquor. For this purpose, there can be used copper-tin bronzes, titanium, and nickel based alloys.

The drawing schematically shows a cross section through the container. The radiation protective material 1 in the form of an uranium alloy is surrounded outwardly by a thin sheet metal jacket 2.

What is claimed is:

1. A container for the final storage of radioactive waste comprising a radiation protective material inside the container walls having as the radiation protective material a uranium alloy consisting essentially of uranium and at least one alloying element selected from the group consisting of 1 to 5 wt % zirconium, 5 to 15 wt % molybdenum, 2 to 15 wt % of copper, 0.5 to 5 wt % chromium, 0.5 to 2 wt % nickel, 0.5 to 1.5 wt % niobium, and 0 to 5 wt % iron, balance being uranium with the proviso that the total content of the metals alloyed with the uranium is 10 to 16 wt % and the total of chromium, nickel, and niobium is at least 1.5%.

2. A container according to claim 1 free from iron.

3. A container according to claim 1 containing zirconium and free from copper.

4. A container according to claim 1 containing both copper and zirconium.

5. A container according to claim 1 containing both chromium and nickel.

6. A container according to claim 1 containing both chromium and niobium.

7. A container according to claim 1 wherein the alloy consists of uranium, zirconium and two of the elements selected from the group consisting of chromium, nickel, niobium, molybdenum and copper.

8. A container according to claim 1 wherein wherein the alloy consists of uranium, molybdenum, zirconium, chromium and nickel.

9. A container according to claim 1 wherein the alloy consists of uranium, molybdenum, zirconium and niobium.

10. A container according to claim 1 wherein the alloy consists of uranium, copper, zirconium, chromium and niobium.

11. A container according to claim 1 wherein the alloy consists of uranium, copper, zirconium, chromium and nickel.

12. A container according to claim 1 consisting essentially of (1) uranium, (2) zirconium, (3) at least one element from the group consisting molybdenum and copper and (4) at least one element selected from the group consisting of chromium, nickel and molybdenum.

* * * * *